US005090397A

United States Patent [19]

Larsen et al.

[11] Patent Number: 5,090,397

[45] Date of Patent: Feb. 25, 1992

[54] PILE CUTTER SUPPORT

[75] Inventors: Robert H. Larsen, Glastonbury; B. Holt Whatley, East Haddam; William D. Glynn, Suffield, all of Conn.

[73] Assignee: Sinco, Inc., East Hampton, Conn.

[21] Appl. No.: 516,162

[22] Filed: Apr. 30, 1990

[51] Int. Cl.[5] ..... B28D 1/04

[52] U.S. Cl. ..... 125/14; 248/231; 248/218.4; 182/187; 182/92

[58] Field of Search ..... 125/14, 23.01, 13.01; 51/241 B, 241 S; 248/231, 218.4; 182/187, 92, 100

[56] References Cited

U.S. PATENT DOCUMENTS 4,233,954 11/1980 Visser ..... 125/14

4,368,720 1/1983 Destree ..... 125/14

FOREIGN PATENT DOCUMENTS 8401997 5/1984 PCT Int'l Appl. ..... 248/218.4

*Primary Examiner*—Robert A. Rose

*Attorney, Agent, or Firm*—Chilton, Alix & Van Kirk

[57] ABSTRACT

A pile cutter support comprises a pair of sections which engage opposing faces of a pile. Platforms integrally extend from the engagement portions in a generally perpendicular relationship so as to form a guide and a support for a cutter. The sections are pivotal between a deployed position wherein the sections are engageable against adjacent faces of the pile and a folded compact carrying mode. A ratchet belt is employed to secure the support at a fixed vertical position of the pile.

19 Claims, 3 Drawing Sheets

PILE CUTTER SUPPORT

BACKGROUND OF THE INVENTION

This invention relates generally to the technology associated with cutting concrete piles. More particularly, the present invention relates to the process of cutting the top portions of concrete piles by cutters such as pneumatic saws.

In the construction industry, after concrete piles have been completed, it is usually necessary to cut the tops of the piles to suitably configure the piles for the structures to be supported by the piles. An effective conventional tool for cutting piles is a pneumatic saw which incorporates a diamond blade or an abrasive wheel. During the cutting operation, the cutting tool is conventionally manually supported and guided by the operator for scoring the pile. After scoring four sides of the pile, the top portion of the pile is removed by an impact from a bucket loader or other heavy equipment. The performance and useful life of the saw is in part a function of the ability of the saw operator to maintain the proper angular and linear attitude of the saw with respect to the pile. For conventional cutting techniques, the ability to maintain the desired attitude is affected by a number of factors, including the weight of the saw, the topography of the surrounding area, the physical condition of the operator, the composite material of the pile and the pile configuration.

SUMMARY OF THE INVENTION

Briefly stated, the invention in a preferred form is a support for a pile cutter which is removeably mountable to the pile and is employed to support and guide the cutter during the cutting operation. The pile cutter support comprises a pair of sections which are pivotally connected. Each of the sections comprises an engagement panel which engages against the face of a pile and a guide platform which is disposed generally perpendicularly to the engagement panel. The guide platforms are generally co-planar and the sections are pivotal so that the engagement panels mutually engage each other in a first storage pivotal position and are disposed in perpendicular relationship at a second deployed pivotal position.

A mounting assembly mounts the support to a pile so that the first and second engagement panels engage adjacent faces of the pile and the guide platforms extend generally perpendicularly relative to the adjacent faces. The sections have opposing edges which engage along a medial diagonal in the second pivotal position. The engagement panels each define a window. A plurality of laterally spaced bars are disposed across the window. The mounting assembly preferably comprises a flexible web which extends around a selected bar and through each of the windows. The selected bar is a function of the dimensions of the pile.

The guide platforms may comprise support panels which have a plurality of openings. A projection is fixedly mounted on one of the support panels and frictionally engages the other support panel when the support sections are at the second pivotal position. The projections may extend at a small acute angle to the support panels. The mounting assembly preferably comprises a flexible belt which is wrapped around the pile and a ratchet assembly for ratcheting the belt to a taut configuration around the pile. The pivotal connector may comprise a hinge.

An object of the invention is to provide a new and improved support for a pile cutter employed for cutting a pile.

Another object of the invention is to provide a new and improved pile cutter support which enhances the quality of the cutting operation, the useful life of the cutter and the safety of the person performing the cutting.

A further object of the invention is to provide a new and improved pile cutter support which is efficiently mountable to the pile for supporting the pile cutter and is easily demountable from the pile after cutting is completed.

A yet further object of the invention is to provide a new and improved pile cutter support of light weight compact form for more precisely aligning the cutter with the pile and which may be suitably stored and transported.

Other objects and advantages of the invention will become apparent from the drawings and the specification.

DETAILED DESCRIPTION OF THE PREFERRED EMBODIMENT

Figure 6:
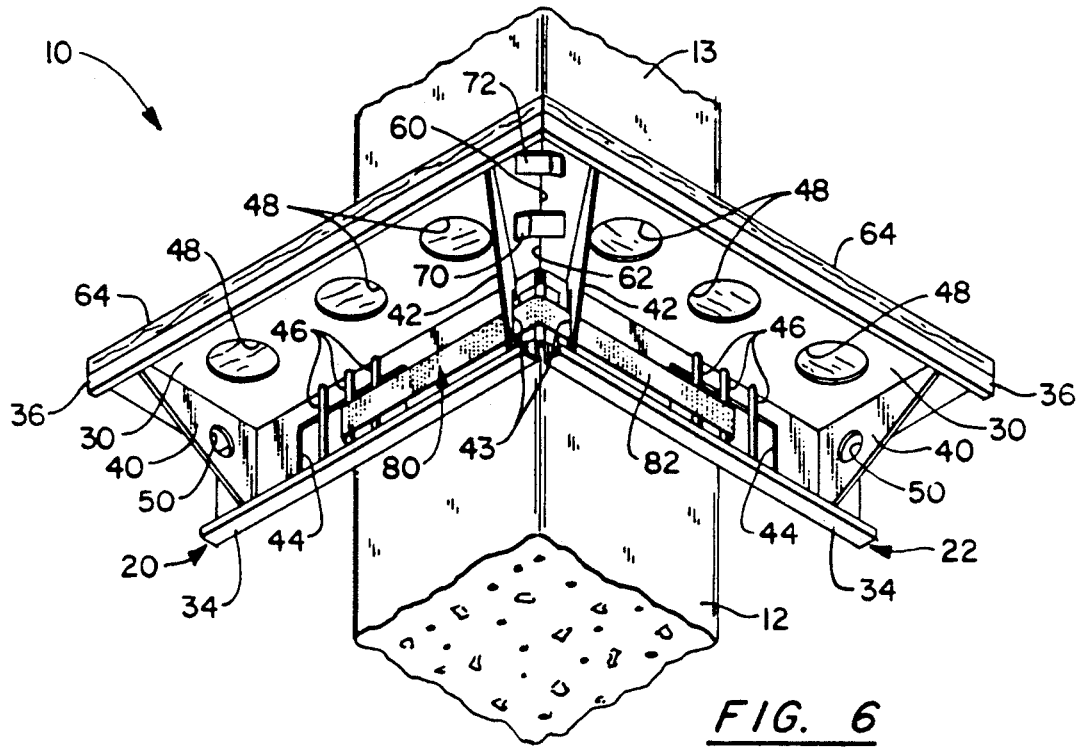
FIG. 6 is a perspective view of the pile cutter support of FIG. 1 mounted to a portion of a pile.
Figure 7:
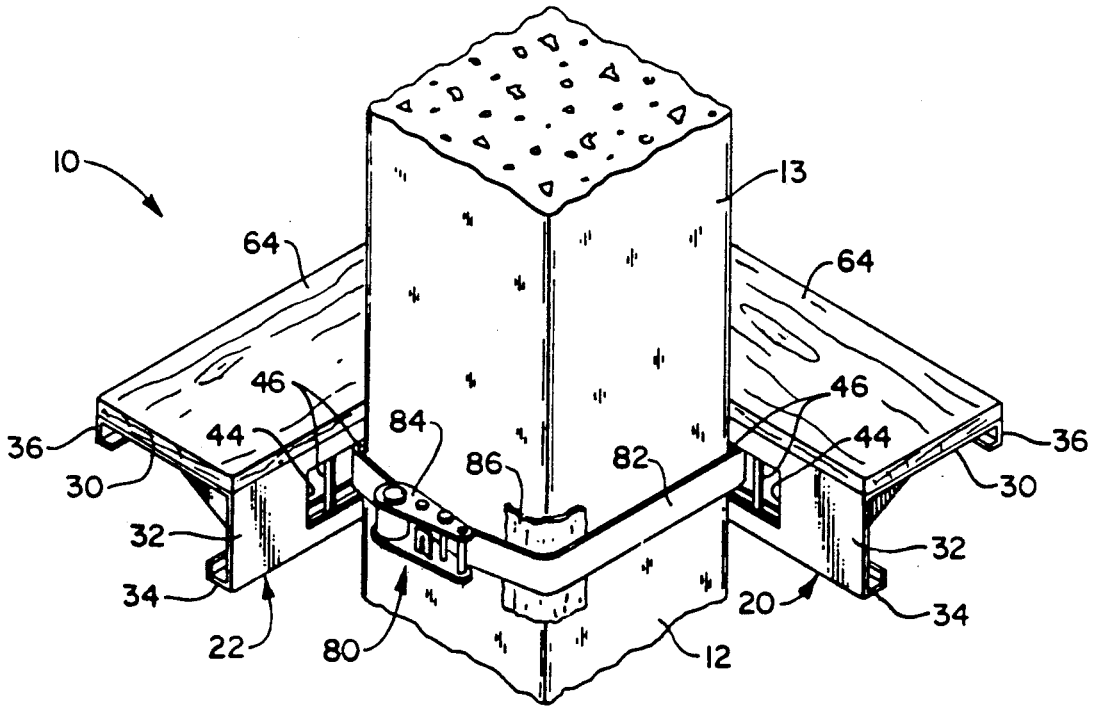
FIG. 7 is a perspective view of the pile cutter support and the pile of FIG. 6 viewed generally from the upper rear thereof.

With reference to the drawings wherein like numerals represent like parts throughout the figures, a pile cutter support in accordance with the present invention, is generally designated by the numeral 10. The pile cutter support 10 is especially adapted for mounting to a concrete pile 12, such as illustrated in FIGS. 6 and 7, to provide a support and guide for a cutter (not illustrated) employed to cut the top portion 13 from the pile base. The support 10 is especially adapted for use in connection with a pneumatic drive saw having a diamond blade or an abrasive wheel which cuts into the concrete and steel composite. The saw scores the pile to permit removal of the top portion 13 from the pile upon delivery of a force from an impacting load such as a blow from a bucket loader. The pile cutter support 10 is especially configured for use in connection with a pile having a pair of adjacent perpendicular faces. The pile cutter support 10 folds to a compact mode illustrated in FIG. 8 for storage and transportation.

The pile cutter support 10 comprises a pair of cooperative sections 20 and 22 which pivotally connect by means of a hinge 24. Sections 20 and 22 may be described as mirror images of each other. Many of the dimensions, structures, and features of the sections 20 and 22 are preferably substantially identical and will generally be described with respect to section 20, it being understood that the other section 22 has a similar corresponding construction.

Section 20 is a rigid steel frame member formed of steel or other suitable materials. The section 20 includes a trapezoidal support panel 30 and an integral generally rectangular engagement panel 32 which extends at right angles to the support panel. The engagement panel 32 is adapted for engaging against one of the faces of the concrete pile. A dual folded stiffening edge 34 is integrally formed along the lower outer bottom of the engagement panel to structurally reinforce or rigidify the panel. Likewise, another dual folded stiffening edge 36 traverses the outer downward portion of the support panel 30 to enhance the structural rigidity of the section. The support panel 30 essentially functions as a support and guide platform for the section 20. In one embodiment, the support panel is approximately 10 inches wide and has a maximum length dimension of approximately 34 inches. The structural integrity of the section is also enhanced by a transverse gusset 40 and a diagonal gusset 42 which rigidly connect the support panel and the engagement panel. Gussets 42 have inner recesses 43 (FIG. 6) which receive a mounting belt as will be further described.

A rectangular window 44 is formed in the engagement panel 32. Laterally spaced adjustment bars 46 extend from the lower stiffening edge 34 to the support panel 30 so as to vertically traverse across the window 44. The bars 46 are rigidly welded in position. In preferred form, three adjustment bars are positioned at approximately 12, 14 and 16 inches lateral spacing from the pivot axis of hinge 24.

Circular openings 48 and 50 may be formed in the respective support panel 30 and gussets 40 and 42 to lighten the weight of the support 10. In one embodiment, the cutter support 10 weighs approximately 18 lbs.

Figure 1:
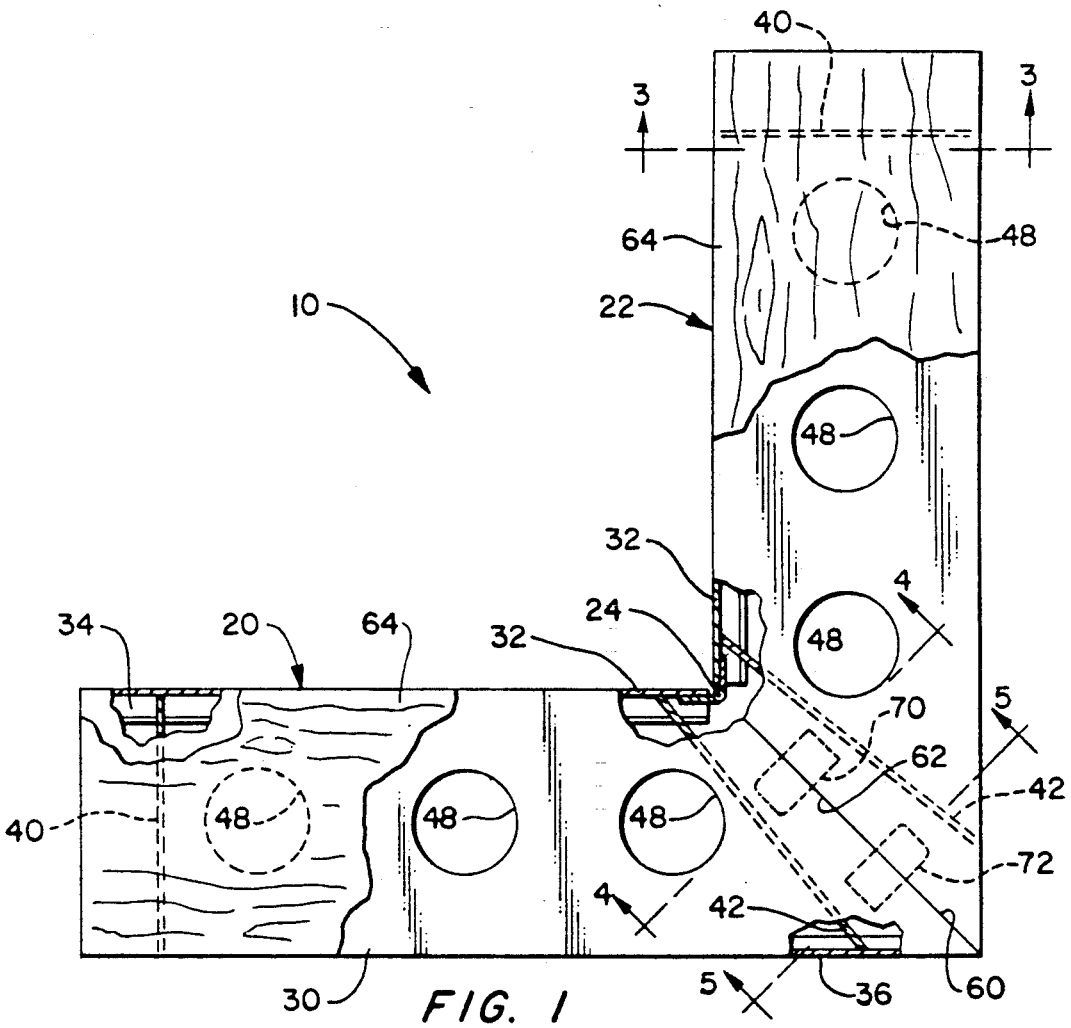
FIG. 1 is a top plan view, partly broken away, partly in section and partly in phantom, of a pile cutter support in accordance with the present invention.
Figure 2:
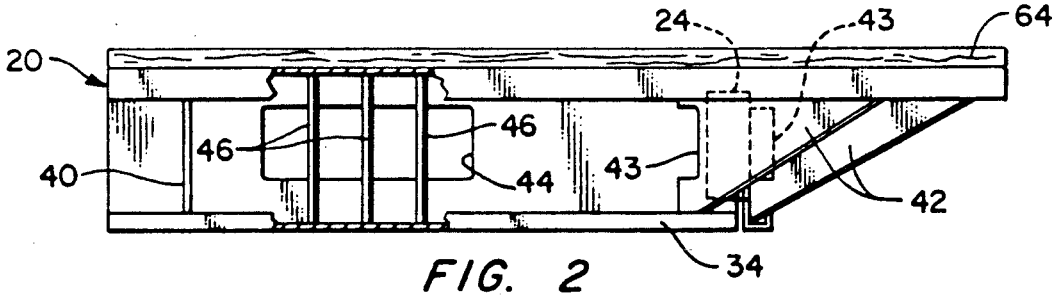
FIG. 2 is a side elevational view, partly broken away and partly in section, of the pile cutter support of FIG. 1.
Figure 3:
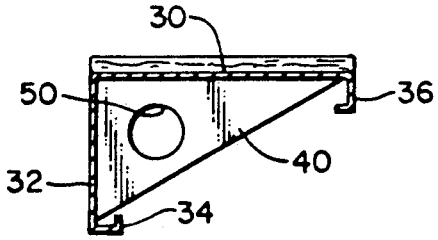
FIG. 3 is a sectional view of the pile cutter support of FIG. 1, taken along the line 3—3 thereof.

Each of the sections 20 and 22 have respective engagement edges 60 and 62 which extend at 45° angles and mutually converge in the deployed configurations illustrated in FIGS. 1, 6 and 7. An optional thin sheet 64 of oak or other abrasion resistant material may be mounted on the panels to eliminate abrasion between the pile cutter and the guide surface.

Figure 4:
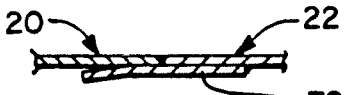
FIG. 4 is an enlarged fragmentary sectional view of the pile cutter support of FIG. 1, taken along the line 4—4 thereof.
Figure 5:
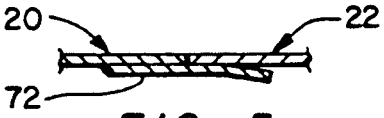
FIG. 5 is an enlarged fragmentary sectional view of the pile cutter support of FIG. 1, taken along the line 5—5 thereof.

With reference to FIG. 4, an alignment tab 70 is welded at the underside of support panel 30 of section 22 and projects beyond the engagement edge 62 for frictionally engaging the underside of the opposing support panel 30 of section 20. Likewise, a second alignment tab 72 is welded at the underside of support panel 30 of section 20 and projects beyond the corresponding edge 60 for frictionally engaging the underside of the closing support panel 30 of section 22. The tabs 70 and 72 cooperate to facilitate proper co-planar alignment of the support panels in the expanded deployed configuration of the cutter support 10. Each of the tabs preferably is bent at an angle of approximately 7° to facilitate the alignment between the two support panels as the sections are pivoted into convergent engagement.

A ratchet belt assembly, designated generally by the numeral 80, includes a webbed belt 82 which is passed through recesses 43 of the diagonal gussets 42, around one of the adjustment bars 46 and through windows 44 for wrapping around the pile, as best illustrated in FIGS. 6 and 7. A ratchet head 84 of conventional form is employed for tightening the belt 82 against the pile to thereby secure the sections to the pile. A scrap cardboard lining 86 or another suitable liner may be disposed between the pile corner and the belt 82 to prevent abrasion against the webbed belt.

Figure 8:
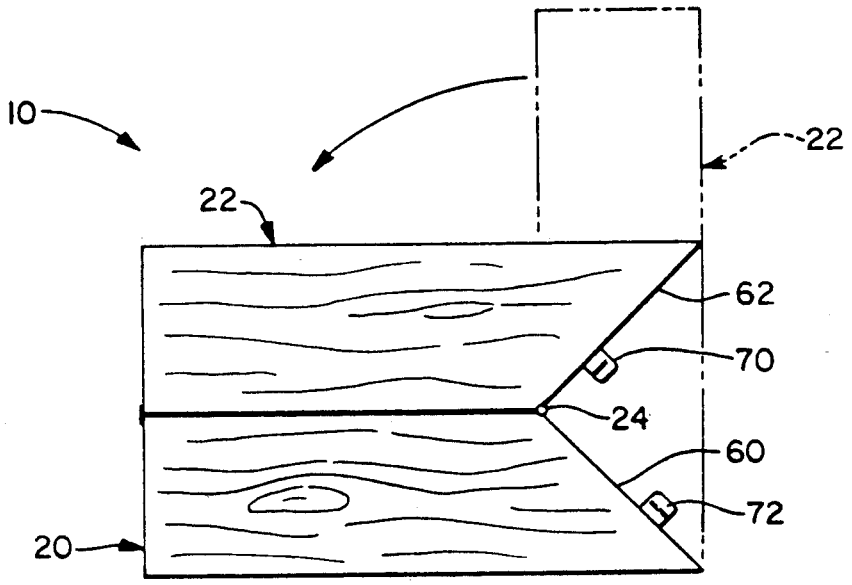
FIG. 8 is a top plan view, partly in schematic, illustrating the compact storage configuration of the pile cutter support of FIG. 1.

It will be appreciated that after completion of the cutting, the webbed belt may be disengaged and the support assembly may be folded to a compact storage and transportation configuration as best illustrated in FIG. 8. In the latter configuration, the engagement panels 32 essentially mutually engage in surface-to-surface relationship and may be secured together by means of the ratchet belt.

The adjustment bars 46 provide an efficient mechanism wherein the cutter support may be suitably mounted to piles having a wide variety of dimensions, such as, for example, 10 to 18 inches. The belt 82 may then be passed around the bar which best matches the dimension of the pile. The belt is tightened by the ratchet head 84, and the engagement panels are thus forced against adjacent faces of the pile. Other means for temporarily fixedly securing the cutter support to the pile may also be employed.

In operation, the operator uses the guide surfaces whether at the top of the guide panels 30, or alternatively the top surface of sheets 64, for supporting and guiding the cutter (not illustrated) to thereby score a parting plane for the top portion 13 of the pile. The support is vertically positioned on the pile slightly below the desired cutting plane. The guide surfaces not only function as a guide to ensure a precise attitudinal alignment for the cut, but also support the cutter and ensure that the cutter blade is properly aligned relative to the pile. The cutter blade may then be moved into the pile and across the adjacent faces of the pile along a cutting plane precisely defined by the guide surfaces. After the pile has been cut across two faces, the support is removed and the engagement panels repositioned against the opposing uncut faces. The ratchet belt assembly is retightened and the cutting process completed.

The pile cutter support is easily mounted and dismounted from the pile. After usage the cutter support is pivoted to the compact folded configuration as illustrated in FIG. 8 for storage and transportation.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit or the scope of the present invention.

What is claimed is:

1. A pile cutter support comprising:

a first support section comprising first engagement means for engaging against a face of a pile and first platform means for forming a first platform;

a second support section comprising second engagement means for engaging against a face of a pile and second platform means for forming a second platform;

pivotal connector means for pivotally connecting said first and second sections wherein said first and second platforms are generally co-planar and said first and second engagement means mutually engage each other in a first pivotal position and are positioned in generally perpendicular relationship at a second pivotal position; and mounting means mounted to said first and second sections for mounting said support to a pile so that said first and second engagement means engage adjacent faces of said pile and said platforms project outwardly generally perpendicular thereto.

2. The pile cutter support of claim 1 wherein said first and second platform means further define opposing edges which engage along a medial diagonal in said second pivotal position.

3. The pile cutter support of claim 1 wherein at least one of said engagement means further comprises a laterally extending panel.

4. The pile cutter support of claim 3 wherein said at least one panel defines a window and a plurality of laterally spaced bars are disposed across said window.

5. The pile cutter support of claim 4 wherein said mounting means comprises a flexible web, said web extending around a selected bar and through said window.

6. The pile cutter support of claim 1 wherein said first and second platform means comprise a pair of support panels.

7. The pile cutter support of claim 6 wherein said support panels define a plurality of openings.

8. The pile cutter support of claim 6 further comprising a projection fixedly mounted to one of said support panels and frictionally engaging the other support panel when said sections are at the second pivotal position.

9. The pile cutter support of claim 8 further comprising a second projection fixedly mounted to said other support panel and frictionally engaging the on support panel when said sections are at the second pivotal position.

10. The pile cutter support of claim 9 wherein said projections extend at a small acute angle relative to said support panels.

11. The pile cutter of claim 1 wherein said mounting means comprises a flexible belt wrappable around said pile.

12. The pile cutter support of claim 11 further comprising ratchet means for ratcheting said belt to a taut configuration around said pile.

13. The pile cutter support of claim 12 further comprising pairs of corresponding laterally spaced bars equidistantly spaced from said pivotal connector means and engageable by said belt.

14. The pile cutter support of claim 1 wherein said pivotal connector means comprises a hinge mounted to each of said engagement means.

15. The pile cutter support of claim 1 wherein said first and second platform means further define opposing edges which engage along a medial diagonal.

16. A pile cutter support comprising:

a first support section comprising first engagement means for engaging against a face of a pile and first guide frame means for defining a generally planar first guide surface disposed generally perpendicularly to said first engagement means, said first guide frame means having a first diagonal edge;

a second support section comprising second engagement means for engaging against a face of a pile and second guide frame means for defining a generally planar second guide surface disposed generally perpendicularly to said second engagement means, said second guide frame means having a second diagonal edge; and connector means comprising a hinge for pivotally connecting said first and second sections wherein said first and second guide surfaces are generally co-planar and said first and second engagement means mutually engage each other in a first pivotal position and are positionable in perpendicular relationship wherein said edges mutually engage at a second pivotal position.

17. The pile cutter support of claim 16 further comprising a projection mounted to one of said first and second guide frame means and engageable with said other guide frame means at the second pivotal position.

18. The pile cutter support of claim 16 further comprising ratchet belt means comprising a belt which is positionable around portions of said first and second sections and the pile and tightenable against said pile by means of a ratchet drive.

19. A pile cutter support comprising:

a first support section comprising first engagement means for engaging against a face of a pile and first platform means for forming a generally planar platform surface disposed generally perpendicularly to said first engagement means, said first engagement means defining a first window;

a second support section comprising second engagement means for engaging against a face of a pile and second platform means for forming a generally planar second platform surface disposed generally perpendicularly to said second engagement means, said second engagement means defining a second window;

connector means for connecting said first and second sections wherein said first and second platform surfaces are generally co-planar and said first and second engagement means are engageable against adjacent faces of a pile; and mounting means for mounting said support to a pile at a selected vertical position thereof so that said first and second engagement means engage adjacent faces of said pile, said mounting means comprising a flexible member which wraps around portions of said engagement means, extends through said first and second windows and circumferentially engages said pile.

* * * * *